United States Patent [19]

Kapp et al.

[11] Patent Number: 4,685,732

[45] Date of Patent: Aug. 11, 1987

[54] FOLDING CHAIR

[75] Inventors: Manfred Kapp; Ulrike Gattermeyer-Kapp, both of Munich; Alexander Harty, Untersiemau, all of Fed. Rep. of Germany

[73] Assignee: Loga Mobel GmbH, Fed. Rep. of Germany

[21] Appl. No.: 1,468

[22] Filed: Jan. 8, 1987

[30] Foreign Application Priority Data

Jan. 13, 1986 [DE] Fed. Rep. of Germany ... 8600622[U]
Oct. 23, 1986 [EP] European Pat. Off. ..... 86114650.4

[51] Int. Cl.[4] ..... A47C 4/24
[52] U.S. Cl. ..... 297/35; 297/16; 297/39; 297/48; 297/58
[58] Field of Search ..... 297/16, 34, 35, 39, 297/46, 48, 51, 52, 55, 57, 58, 418

[56] References Cited

U.S. PATENT DOCUMENTS

| | | | |
|---|---|---|---|
| 2,649,138 | 8/1953 | Rechler | 297/39 X |
| 2,957,516 | 10/1960 | Kubisz | 297/46 |
| 3,715,142 | 2/1973 | Lay et al. | 297/39 |
| 4,130,316 | 12/1978 | Rossi | 297/46 |
| 4,191,419 | 3/1980 | Kirkpatrick | 297/48 |
| 4,614,377 | 9/1986 | Luo | 297/35 X |

FOREIGN PATENT DOCUMENTS

| | | | |
|---|---|---|---|
| 1144515 | 10/1957 | France | 297/39 |

*Primary Examiner*—Kenneth J. Dorner
*Assistant Examiner*—Peter R. Brown
*Attorney, Agent, or Firm*—Bacon & Thomas

[57] ABSTRACT

A folding chair defined by a U-shaped rest, a seat, a pair of vertically extending front legs and a pair of obliquely downwardly extending rear legs, wherein the rest, the front legs and the rear legs are connected together for pivotal movement about a first transverse axis. Each rear leg is provided with a slider to which first, second and third struts are connected for pivotal movement about a second transverse axis, with the first strut being connected to the rest, the second strut being connected to the seat and the third strut being connected to a front leg for pivotal movement about third, fourth and fifth transverse axes, respectively. The seat is connected to the front legs for pivotal movement about a sixth transverse axis and is supported on the pair of sliders. All first and third struts are disposed in the same plane, intersecting a surface defined by the pair of rear legs. The chair is folded by raising the seat upwardly, thereby moving the sliders upwardly along the rear legs so that the rest and the rear legs are caused to pivot toward the front legs, with the first, second and third pairs of struts being caused to engage the rest, the seat and the front legs, respectively.

10 Claims, 8 Drawing Figures

FOLDING CHAIR

BACKGROUND OF THE INVENTION

1. Field of the Invention

The present invention generally involves the field of technology pertaining to chairs. More particularly, the invention relates to an improved chair of the folding type wherein the chair may be disposed between an extended position for use and a collapsed position for transport or storage.

2. Description of the Prior Art

Folding chairs, such as disclosed by German Utility Model Registration No. 1958,878, are well known in the prior art. A chair of this type may include pairs of front and rear legs which form two folding cross strut assemblies on the one and respectively the other side of the seat and disposed below a U-shaped arm and back rest. The cross strut assemblies are connected to each other by two transverses which extend between the pairs of front and rear legs, respectively and serve to support the seat which pivots on the transverse connecting the front legs and can be locked to the transverse connecting the rear legs. The pivots of the cross strut assemblies define a first transverse axis about which the front and rear legs may pivot relative to each other. The rear legs are rotatably supported at each upper end by a pin in a lower bearing at the corresponding side arm of the rest which is mounted adjacent the free end of the side arm. The front legs crossing the rear legs extend oppositely in a sloping disposition, with the front legs being also each provided at their upper ends with a pin seated, however, in a longitudinal slot of the bearing at the corresponding side of the chair. The pins of the rear legs define a second transverse axis about which the rear legs and the rest may pivot with respect to each other, with the front legs pivoting about the first transverse axis and the pins thereof sliding in the longitudinal slots.

SUMMARY OF THE INVENTION

It is an object of the invention to provide an improved folding chair which is particularly characterized by the advantages of higher stability, simple construction, economical to manufacture, ease of operation and aesthetically pleasing appearance.

This and other objects of the invention are realized through an improved folding chair that is essentially defined by a U-shaped rest, a seat, a pair of vertically extending front legs and a pair of obliquely downwardly extending rear legs. The rest, the front legs and the rear legs are connected together for pivotal movement about a first transverse axis. The pair of rear legs is provided with a pair of sliders to which first, second and third pairs of struts are connected for pivotal movement about a second transverse axis. The first pair of struts is connected to the rest, the second pair of struts is connected to the seat and the third pair of struts is connected to the front legs for pivotal movement about third, fourth and fifth transverse axes, respectively. The seat is connected to the front legs for pivotal movement about a sixth transverse axis and is supported on the pair of sliders. The first and third pairs of struts are disposed in the same plane intersecting a surface defined by the pair of rear legs. The chair is folded by tipping the seat upwardly, thereby also causing the pair of sliders to move upwardly along the rear legs. During this procedure, the rest and the rear legs are caused to pivot toward the front legs, with the pairs of first, second and third struts being caused to engage against the rest, the seat and the front legs, respectively.

Other objects, features and advantages of the invention shall become apparent from the following detailed description of preferred embodiments thereof, with reference to the drawings wherein like reference characters refer to corresponding parts in the several views.

DETAILED DESCRIPTION OF THE PREFERRED EMBODIMENTS

Figure 2:
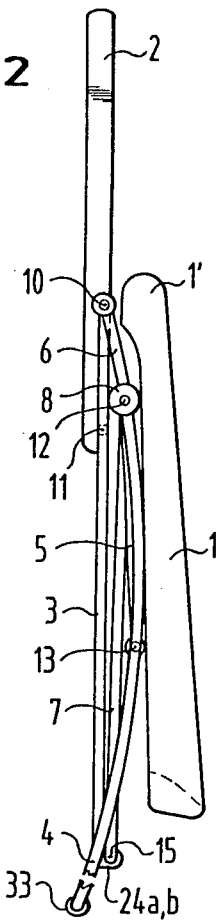
FIG. 2 is a side view of the chair shown in FIG. 1, wherein the chair is in a collapsed position for transport or storage.
Figure 3:
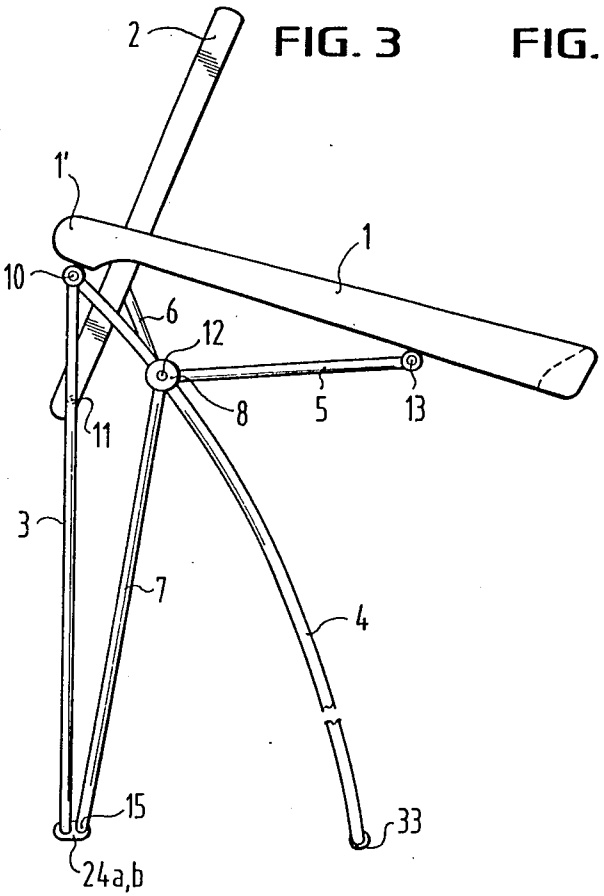
FIG. 3 is a side view of the chair of FIG. 1 depicting the chair in an intermediate position between the extended and collapsed positions.

With reference to the drawings, and particularly FIGS. 1–4, a folding chair according to a first embodiment of the invention is shown to comprise a U-shaped rest 1, a seat 2 that is narrower than rest 1 and having a corresponding U-shaped configuration, a pair of front legs 3, a pair of rear legs 4, a pair of first struts 5, a pair of second struts 6, a pair of third struts 7, and a pair of sliders 8.

The two upper ends of the front legs 3, the two upper ends of the rear legs 4, and the two front ends 1' of the rest 1 are connected together by two articulations on opposed sides of the chair for pivotal movement about a common transverse axis 10. In the vicinity of its straight front edge, seat 2 is connected for pivotal movement about a transverse axis 11 with front legs 3. The sliders 8 are carried by rear legs 4 for connection to first, second and third pairs of struts 5, 6 and 7 so as to be pivotable about a common transverse axis 12. The first pair of struts 5 is connected to rest 1, the second pair of struts 6 is connected to seat 2 and the third pair of struts 7 is connected to front legs 3 for pivotal movement about transverse axes 13, 14 and 15, respectively. Seat 2 is connected to front legs 3 for pivotal movement about transverse axis 11 and is supported on the pair of sliders 8. As also shown, sliders 8 are mounted on rear legs 4 so as to be slidable therealong, with rear legs 4 being curved and extending obliquely downwardly and rearwardly, and also of greater length than front legs 3.

Figure 1:
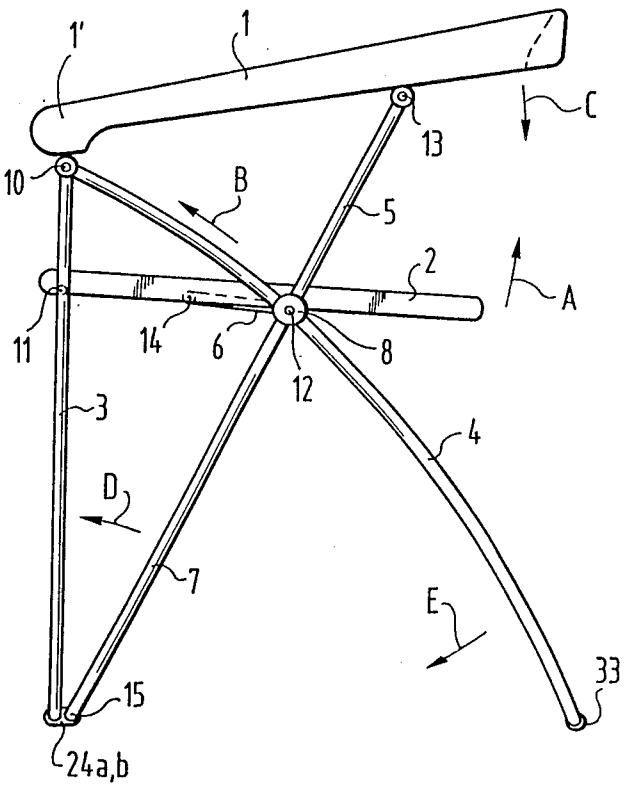
FIG. 1 is a side view of a folding chair according to a first embodiment of the invention and shown in an extended position for use.
Figure 5:
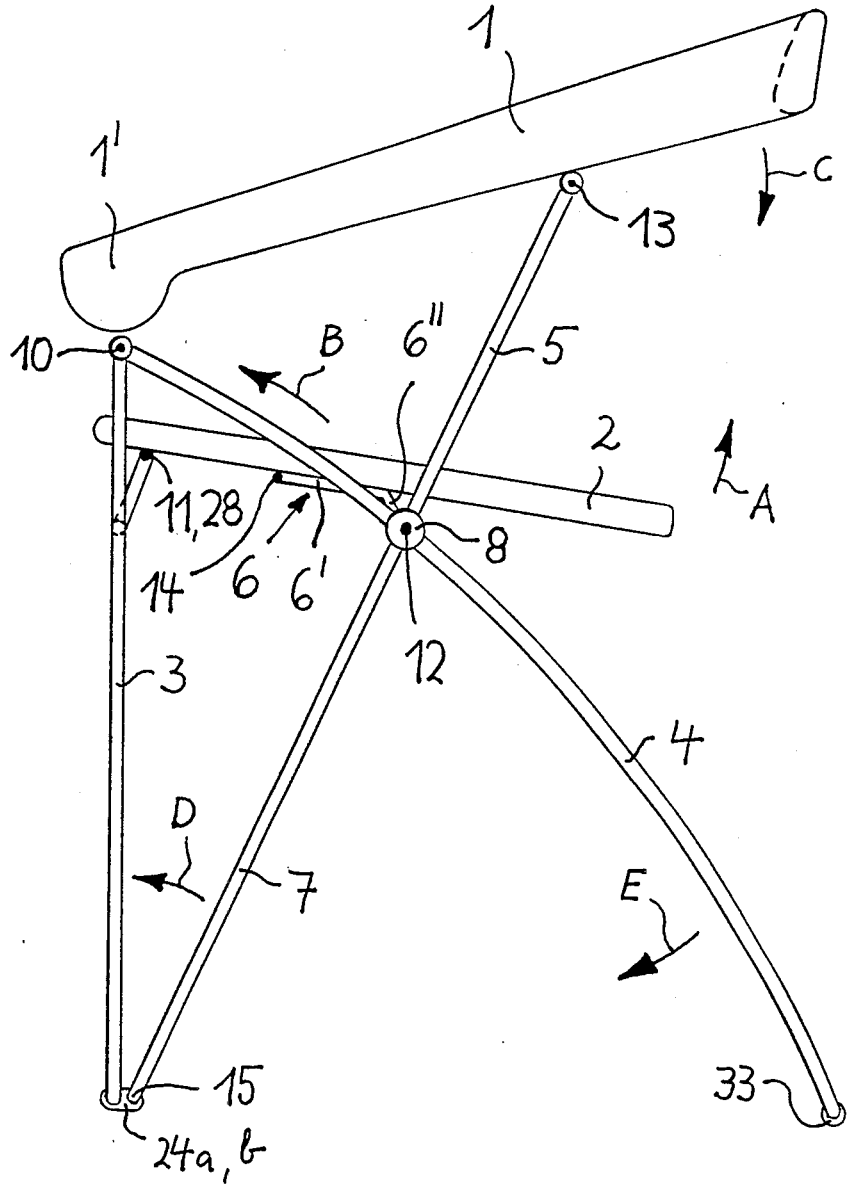
FIG. 5 is a side view of a folding chair according to a second embodiment of the invention and shown in an extended position for use.

When the chair is disposed in the extended position for use, as shown in FIGS. 1 and 5, the pair of front legs 3 is disposed in an essentially vertical position, while the pair of rear legs 4 extends obliquely downwardly and reawardly from first transverse axis 10. The first pair of struts 5 and the third pair of struts 7 are disposed in the same plane extending between third and fifth transverse axes 13 and 15. This plane also includes second transverse axis 12 which defines the common pivot axis of all struts 5, 6 and 7 with respect to sliders 8. The plane crosses a surface defined by the pair of rear legs 4. As also seen, second pair of struts 6 is approximately parallel to seat 2. Rest 1 and seat 2 are disposed substantially horizontally as seen in FIGS. 1 and 5, with rest 1 sloping slightly upwardly and seat 2 sloping slightly downwardly in the rearward direction. Seat 2 is supported on the pair of front legs 3 at sixth transverse axis 11 and on inner projections 20 of sliders 8. Sliders 8 are prevented from moving down on rear legs 4 because of their connection to front legs 3 by both the second pair of struts 6 and seat 2, and also by the third pair of struts 7. Rest 1 is supported on the pair of front legs 3 and on the first pair of struts 5.

Figure 6:
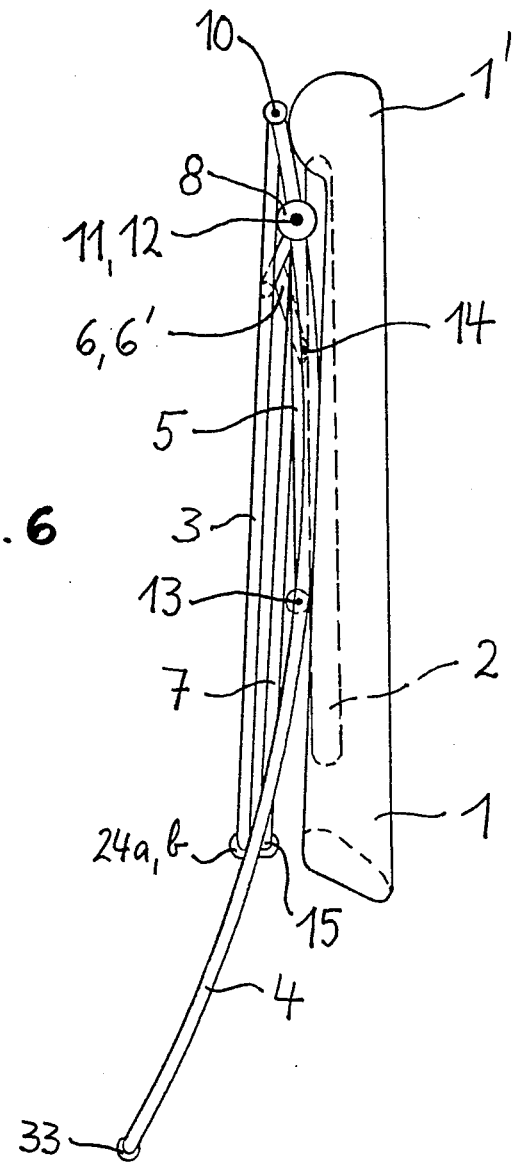
FIG. 6 is a side view of the chair shown in FIG. 5, with the chair being in a collapsed position for transport or storage.
Figure 7:
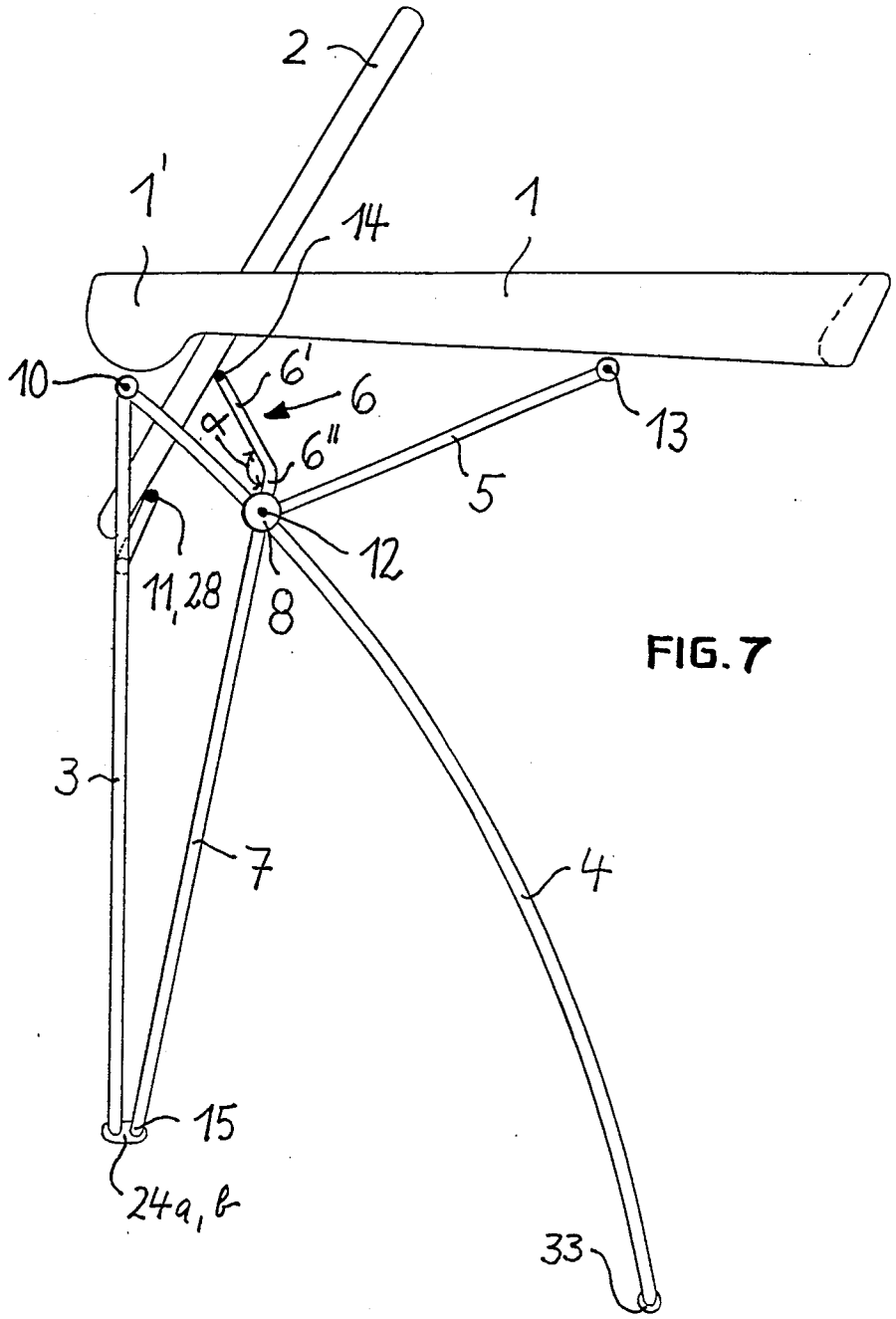
FIG. 7 is a side view of the chair shown in FIG. 5, with the chair being disposed in a first intermediate position between the collapsed and extended positions.
Figure 8:
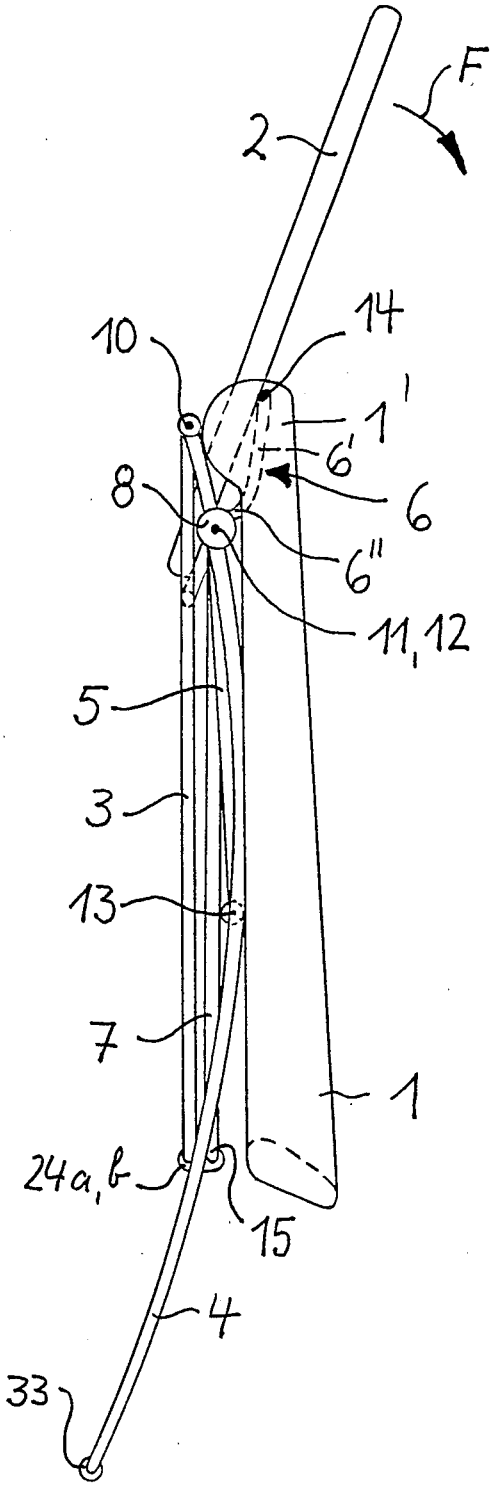
FIG. 8 is a side view of the chair shown in FIG. 5, with the chair being disposed in a second intermediate position between the extended and collapsed positions.

In order to fold the chair from the extended position for use, as shown in FIGS. 1 and 5, into the collapsed position for transport or storage, as shown in FIGS. 2 and 6, it is only necessary to grasp the rear edge of seat 2 and pivot same in the direction indicated by arrow A in FIGS. 1 and 5. This causes the two sliders 8 to shift on their corresponding rear legs 4 in the direction of arrow B as shown in FIGS. 1 and 5. As a result of this movement, first pair of struts 5 pivots downwardly toward third pair of struts 7, during which rest 1 also pivots in the direction indicated by arrow C as shown in FIGS. 1 and 5. Simultaneously, third pair of struts 7 and rear legs 4 pivot in the direction of arrows D and E, respectively, as also shown in FIGS. 1 and 5. This causes the chair to be folded into the intermediate position shown in FIGS. 3 and 7, and ultimately into the collapsed position for transport or storage as shown in FIGS. 2 and 8. As shown in FIG. 8, seat 2 of the embodiment shown in FIG. 5 may further be pivoted downwardly in the direction indicated by arrow F to realize the final collapsed position as shown in FIG. 6.

It should further be noted that, at the moment the first pair of struts 5 and the third pair of struts 7 are flipped or pivoted towards each other, the collapsing procedure can be enhanced by applying additional force on rest 1 in the direction indicated by arrow C, as shown in FIGS. 1 and 5. As further indicated in FIGS. 3 and 7, rest 1 and seat 2 move past each other during folding of the chair into the collapsed position for transport or storage. The final collapsed position of the chair as shown in FIG. 6 includes the disposition of seat 2 within rest 1.

When the folding chair is being disposed into the extended or collapsed position, a mutual pivoting movement is realized between rest 1, seat 2, front legs 3, rear legs 4 and the three pairs of struts 5, 6 and 7. This pivoting movement occurs about six pivot axes defined by the mutually parallel transverse axes 10–15. This arrangement permits the chair to progress from the extended position for use shown in FIGS. 1 and 5 to the collapsed position for transport or storage as shown in FIGS. 2 and 8, and ultimately to the final collapsed position shown in FIG. 6 wherein seat 2 is received within rest 1.

Figure 4:
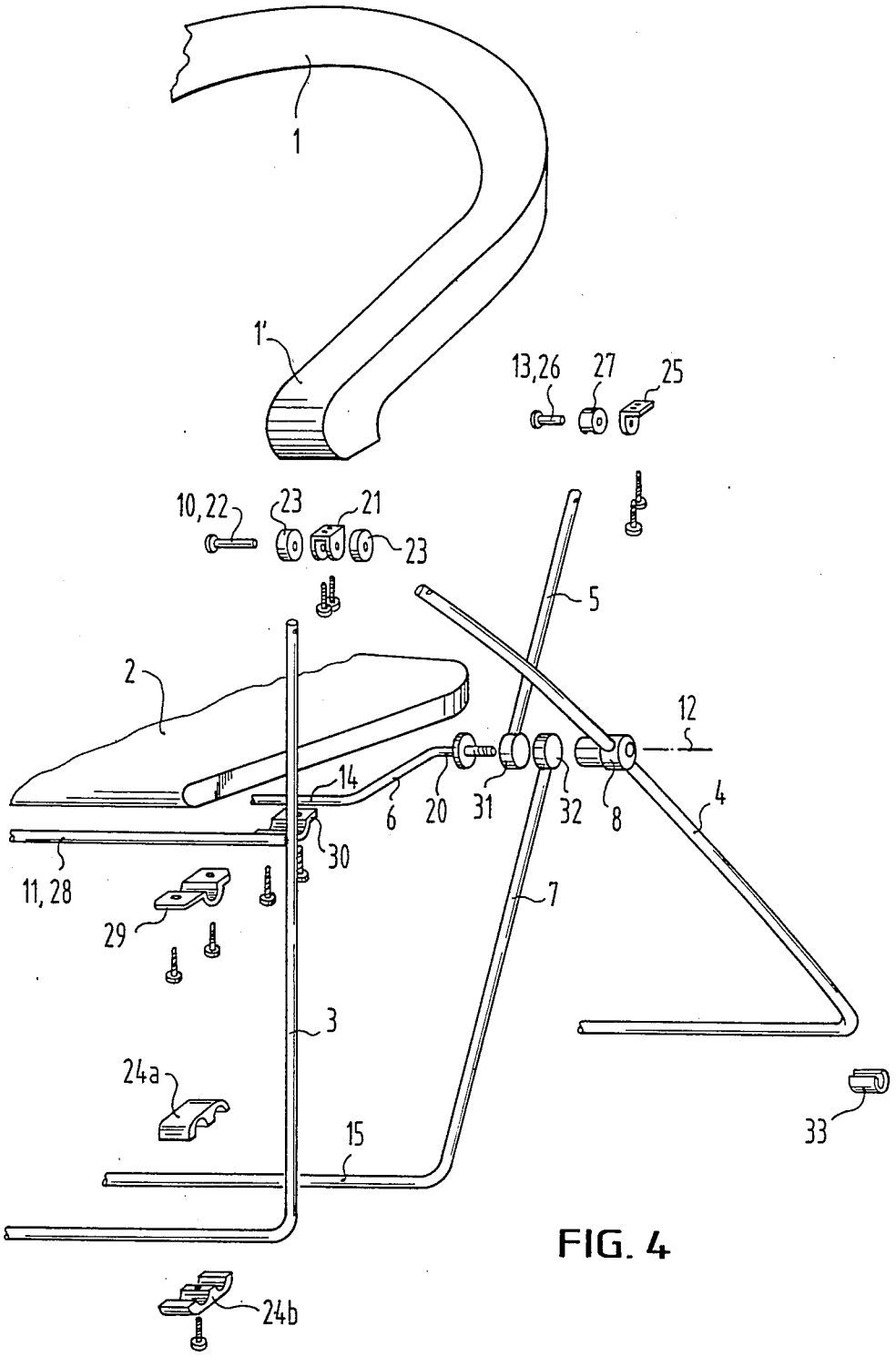
FIG. 4 is an exploded partial perspective view of the chair shown in FIGS. 1–3.

With particular reference to FIG. 4, the pair of front legs 3, the pair of rear legs 4 and the third pair of struts 7 are each formed from a metal segment having a substantially U-shaped configuration of which the cross member of the U-shape serves as the rest for engaging the surface on which the chair is supported. The upper ends of front legs 3 and rear legs 4 are connected at the upper ends of the lateral arms of their U-shaped metal segments on either side of the chair to each other and to rest 1 by means of bearings 21 which are screwed to the lower side of the adjacent front ends 1' of rest 1. This is accomplished on each side by utilizing a support pin 22 and a pair of opposed washers 23. It should be noted that support pins 22 on both sides of the chair form two pivots and collectively define first transverse axis 10.

The two U-shaped metal segments forming the pair of front legs 3 and the third pair of struts 7 are connected together at their lower cross members by plastic hinges, with each hinge including two halves **24*a* and 24*b* which are screwed together in order to seat the cross members for rotational movement. The first pair of struts 5 includes two single metal bars, with each bar being connected at its upper end to rest 1 by an assembly that includes a bearing 25, a support pin 26 and a washer 27. The two support pins 26 also form pivots and collectively define third transverse axis 13. A cross member 28 is disposed between front legs 3 for rotatably supporting seat 2 by means of brackets 29 which are attached to seat 2 by means of screws. It is therefore apparent that cross member 28 serves to define sixth transverse axis 11 and forms the pivot of seat 2**.

The second pair of struts 6 is also defined by a U-shaped metal segment, the cross member of which is rotatably supported by brackets 30 which are screwed onto seat 2, thereby defining the pivot corresponding to fourth transverse axis 14. The ends of the metal segment lateral arms forming struts 6 are bent outwardly to provide inner projections 20 which are threaded so that they may be screwed to sliders 8 on both sides of the chair and maintain two support eyes 31 and 32 on each slider 8 for rotational movement. Support eyes 31 and 32 are located at the adjacent ends of both the first pair of struts 5 and the third pair of struts 7 on either side of the chair.

Appropriately configured bushings 33, preferably formed of plastic, are engaged on the cross member of the U-shaped metal segment forming the pair of rear legs 4 for the purpose of dampening the chair and preventing it from slipping on smooth ground. Hinge parts **24*a* and 24*b*** are also preferably formed of equivalent material for serving the same function.

A chair according to a second embodiment of the invention, as particularly shown in FIGS. 5–8, corresponds essentially in both construction and operation to the previously described chair of the first embodiment as shown in FIGS. 1–4. However, it shall be noted that in this second embodiment, sixth transverse axis 11 defining the pivot of seat 2 is mounted to the pair of front legs 3 in such a manner that when the chair is placed in the two collapsed positions shown in FIGS. 6 and 8, the sixth transverse axis 11 is coincidental and coaxial with the second transverse axis 12. Second transverse axis 12 again defines the common pivot axis of first, second and third pairs of struts 5, 6 and 7 with respect to the pair of sliders 8. By virtue of this arrangement, further collapsing of the chair into its final position for transport or storage can be realized. It shall be noted that seat 2 can be collapsed into rest 1, with the second pair of struts 6 pivoting jointly with seat 2 about the two coincidental transverse axes 11 and 12, thus forming a joint axis for pivoting seat 2 in the direction indicated by arrow F, as shown in FIG. 8.

The placing of the chair according to the second embodiment into in extended position for use and folding of the chair into its collapsed position for transport or storage is realized in the same basic manner as previously described for the chair of the first embodiment except that a more fully collapsed position may be realized as shown in FIG. 6 wherein seat 2 is received within rest 1. Seat 2 must therefore be first lifted from this position during unfolding of the chair into its extended position for use.

With the chair shown in FIGS. 5–8, sixth transverse axis 11, i.e. the pivot axis of seat 2 at front legs 3 is offset from the plane defined by legs 3 towards second transverse axis 12, the latter defining the common pivot axis of first, second and third pairs of struts 5, 6 and 7 at the pair of sliders 8. The pair of front legs 3 is provided with a metal segment of U-shaped configuration defining a cross member 28. The two lateral arms of this metal segment are mounted to the pair of front legs 3 at points spaced from cross member 28. In this manner, the metal segment projects upwardly and obliquely away from the pair of front legs 3, as shown in FIG. 5.

It should further be noted that seat 2 of this second embodiment is supported on the pair of sliders 8 in a manner that is somewhat different from that of the first embodiment. In the second embodiment, each second strut 6 is bent or kinked to define two sections 6' and 6'' which are disposed to form an obtuse angle $\alpha$. The end of first section 6' joins fourth transverse axis 14 to define a pivot axis therewith, while the end of second section 6'' joins second transverse axis 12 to define a pivot axis therewith. As therefore apparent, seat 2 is supported on first section 6' of each strut 6 when the chair is in its extended position for use as shown in FIG. 5. In this latter position, second section 6'' projects from seat 2 obliquely downwardly toward the pair of sliders 8. As previously described for the chair of the first embodiment, the second embodiment may also be provided with a second pair of struts 6 formed from a U-shaped metal segment, the two lateral arms of which may be appropriately bent or kinked to form sections 6' and 6'', and an obtuse angle $\alpha$ therebetween.

It is to be understood that the embodiments of the invention herein shown and described are to be taken as preferred examples of the same, and that various changes in shape, size and arrangement of parts may be resorted to without departing from the spirit of the invention of scope of the subjoined claims.

We claim:

1. A folding chair disposable between an extended position for use and a collapsed position for transport or storage comprising:

(a) a U-shaped rest including a pair of front ends, a seat narrower than the rest and having a corresponding U-shaped configuration and a front edge, a pair of front legs, and a pair of rear legs exceeding the front legs in length;

(b) the front legs extending vertically and the rear legs extending downwardly and rearwardly when the chair is disposed in the extended position;

(c) the front legs and rear legs being connected to each other at two pairs of corresponding ends and to the front ends of the rest pivotal movement about a first transverse axis;

(d) a slider carried by each rear leg for sliding movement therealong;

(e) first, second, and third struts having three corresponding ends connected to each slider for pivotal movement about a second transverse axis;

(f) the other end of each first strut being connected to the rest for pivotal movement about a third transverse axis, the other end of each second strut being connected to the seat for pivotal movement about a fourth transverse axis, and the other end of each third strut being connected to a front leg for pivotal movement about a fifth transverse axis;

(g) the front edge of the seat being connected to the front legs for pivotal movement about a sixth transverse axis; and (h) all first and third struts being disposed in a common plane when the chair is disposed in the extended position;

(i) whereby during folding of the chair into the collapsed position, the pair of sliders move along the rear legs toward the first transverse axis when the seat is pivoted about the sixth transverse axis, thereby causing the rest to pivot downwardly, the rear legs to pivot toward the front legs, and the first, second and third pairs of struts to engage against the rest, the seat and the front legs, respectively.

2. The folding chair of claim 1 wherein the pair of front legs, the pair of rear legs and the third pair of struts are each formed from a U-shaped metal segment, with the cross member of each segment being positioned for engaging a surface on which the chair is supported when the chair is disposed in the extended position for use.

3. The folding chair of claim 1 wherein the first pair of struts is formed from two separate elongate metal segments.

4. The folding chair of claim 1 wherein the second pair of struts is defined by a U-shaped metal segment having a cross member connected to the seat for rotational movement relative thereto.

5. The folding chair of claim 1 wherein the sixth transverse axis is defined by a transverse member supporting the seat for pivotal movement.

6. The folding chair of claim 1 wherein the sixth axis and the the second axis are disposed to coincide when the chair is in the collapsed position for transport or storage.

7. The folding chair of claim 6 wherein each second strut is bent to define first and second sections forming an obtuse angle, with the first section supporting the seat and the second section being connected to the second transverse axis, wherein the second section extends obliquely downwardly and rearwardly when the chair is disposed in the extended position for use.

8. The folding chair of claim 7 wherein the pair of second struts is formed from a U-shaped metal segment, the lateral arms of the segment being bent to define the first and second sections of the struts.

9. The folding chair of claim 6 wherein the sixth transverse axis is offset from the plane defined by the front legs towards the second transverse axis.

10. The folding chair of claim 6 including a U-shaped metal segment mounted to the pair of front legs, the cross member of the segment defining the sixth transverse axis, and the ends of the two lateral arms of the segment remote from the cross member thereof being mounted to the front legs.

* * * * *